US008179218B2

(12) United States Patent
Saho et al.

(10) Patent No.: US 8,179,218 B2
(45) Date of Patent: May 15, 2012

(54) MAGNETIZING SYSTEM AND SUPERCONDUCTING MAGNET TO BE MAGNETIZED THEREWITH

(75) Inventors: Norihide Saho, Tsuchiura (JP); Hisashi Isogami, Ushiku (JP); Hiroyuki Tanaka, Mito (JP)

(73) Assignee: Hitachi, Ltd., Tokyo (JP)

( * ) Notice: Subject to any disclaimer, the term of this patent is extended or adjusted under 35 U.S.C. 154(b) by 416 days.

(21) Appl. No.: 12/353,456

(22) Filed: Jan. 14, 2009

(65) Prior Publication Data

US 2009/0212890 A1 Aug. 27, 2009

(30) Foreign Application Priority Data

Jan. 15, 2008 (JP) ..... 2008-005172

(51) Int. Cl.
*H01F 6/00* (2006.01)
*H01F 13/00* (2006.01)

(52) U.S. Cl. ..... 335/216; 335/284

(58) Field of Classification Search ..... 335/216, 335/296–300, 284; 505/100
See application file for complete search history.

(56) References Cited

U.S. PATENT DOCUMENTS 5,659,278 A * 8/1997 Yanagi et al. ..... 335/216
6,111,490 A * 8/2000 Yanagi et al. ..... 335/216
6,441,711 B2 * 8/2002 Young ..... 335/299
7,750,524 B2 * 7/2010 Sugimoto et al. ..... 310/162
2006/0252650 A1 * 11/2006 Oka et al. ..... 505/100
2009/0188260 A1 * 7/2009 Saho et al. ..... 62/3.6

FOREIGN PATENT DOCUMENTS

JP 07-201560 8/1995
JP 10-011672 1/1998
JP 11-335120 12/1999
JP 2007-250651 9/2007

* cited by examiner

*Primary Examiner* — Anh Mai
*Assistant Examiner* — Bernard Rojas
(74) *Attorney, Agent, or Firm* — Antonelli, Terry, Stout & Kraus, LLP.

(57) ABSTRACT

A magnet magnetizing system and a superconducting magnet to be magnetized, for magnetizing a superconducting magnet to be magnetized, comprises: a magnetizing magnetic field generating means for generating and distinguishing a static magnetic field; a cooling means having an electromotive motor within the static magnetic field, which is generated from the magnetizing magnet generating means; and a bulk superconductor to be magnetized, which is thermally connected with a low-temperature portion of the cooling means, wherein the magnetizing magnetic field generating means is made up with a magnetizing superconducting bulk magnet, building other magnetizing bulk superconductor therein, the bulk superconductor to be magnetized before magnetization thereof is inserted within a space of the static magnetic field, which is generated by the magnetizing superconducting bulk magnet magnetized, and the magnetic field of the magnetizing superconducting bulk magnet is distinguished by the means for cooling the bulk superconductor inserted, down to be equal or lower than superconducting temperature, thereby magnetizing the bulk superconductor to be magnetized.

14 Claims, 8 Drawing Sheets

MAGNETIZING SYSTEM AND SUPERCONDUCTING MAGNET TO BE MAGNETIZED THEREWITH

BACKGROUND OF THE INVENTION

The present invention relates to a magnetizing system and a superconducting magnet to be magnetized therewith.

As conventional art relating to a magnet for use of magnetizing is already known, for example, that having a bulk superconductor, as a target to be cooled by a refrigerator, with using a coil-type superconducting magnet therein.

This magnet for magnetizing is located at a central portion of the superconducting magnet of the coil-type superconducting magnet, a magnetic center of which is cooled down to a very low temperature, and this superconducting magnet is disposed within a heat insulating vacuum container. In case when cooling the bulk superconductor, down to the very low temperature by the refrigerator, the bulk superconductor is disposed within the heat insulating vacuum container, and an end of the bulk superconductor is thermally unified or integrated with a cooling stage of the refrigerator through a heat conductor, indirectly, and thereby building up a bulk superconducting magnet.

The method for magnetizing comprises the following steps (1) to (4):

(1) Generating a predetermined static magnetic field by running current from a magnetizing power source, after cooling the coil-type superconducting magnet for magnetization down to the very low temperature;

(2) Disposing the bulk superconductor of the bulk superconducting magnet before cooling at the position of the center of magnetic field within a bore of the coil-type superconducting magnet for magnetization at room temperature. Herein, fluxes for magnetizing penetrate through within the bulk superconductor;

(3) Turning the power source of the refrigerator for the bulk superconducting magnet "ON", to cool the bulk superconductor down to the very low temperature, equal or lower than a temperature of obtaining the superconducting, and thereby brining the bulk superconductor into the superconducting condition within the static magnetic field; and (4) Demagnetizing the coil-type superconducting magnet for magnetization. The bulk superconductor captures the magnetic fluxes penetrating therethrough, and when completing the magnetization, it generates a magnetic field. The bulk superconducting magnet is taken out from an inside of the bore at room temperature, and thereafter the refrigerator for the bulk superconducting magnet keeps the operation thereof.

Herein, as it was explained in the (3) mentioned above, there is necessity for the refrigerator for the bulk superconducting magnet to be operated under the condition that the coil-type superconducting magnet for magnetization generates the magnetic field.

In general, such the refrigerator mentioned above has a compressor and an expander for compressing/expanding a helium gas therein, since it operates under a refrigerating cycle, having processes or steps for compressing/expanding the helium gas as a working medium thereof. One example of the refrigerator is a one-unit type with the compressor, directly connecting the compressor and the expander, and another example of the refrigerator is a split type of connecting both with tubes, each being separated from each other.

With the split type, since there are useless spaces within the tubes and there is generated a pressure loss when the gas flows within the tubes, with a cooling efficiency thereof is lower than that of the one-unit type with the compressor. Because of lowering of the cooling efficiency and an increase of consumption of electric power, it is not a good policy to apply the split type from a viewpoint of energy saving. Then, explanation will be given hereinafter, on the case of applying the one-unit type with the compressor therein.

Since motor of the compressor, illustrated in FIG. 4, uses magnetic materials, such as, magnetic steel and a permanent magnet, for example, motor cannot be operated within a space of high magnetic field. In general, motor must be operated within a space of low magnetic field, i.e., equal or lower than 0.1 Tesla. On the other hand, it is necessary to generate a very high magnetic field, such as, 5 Tesla to 10 Tesla, for magnetizing a high magnetic field, at a central portion of the coil-type superconducting magnet for magnetization by means of the bulk superconducting magnet. For this reason, within the space near to an end of the coil-type superconducting magnet, to be disposed the compressor therein, there are leakage fluxes of several Tesla; therefore, it is impossible to dispose the above-mentioned compressor. The space where the compressor could be disposed, i.e., being equal or lower than 0.1 Tesla in the magnetic field, is at the position, separating by 0.4 m to 0.7 m from the end of the magnet. Also, because the magnet is disposed within a vacuum heat-shielding space, the distance between the center of magnetic field of the coil-type superconducting magnet and an end of a vacuum container is about 0.3 m. This is because of the following reasons:

A superconducting coil is built up through winding up a superconductive wire or cable by a large number of times, for generating the high magnetic field, and herein, for the purpose of increasing the stability on cooling of the superconducting coil under a very low temperature with a thermal capacity of metal, the superconductive cable is wound around a core of a cold accumulating body, for example made of copper, by the large number thereof, and therefore the weight of the magnet is heavy. A heat-shielding support body comes to be long, for supporting that weight by that heat-shielding support body within the vacuum space and for preventing heat from invading therein from the portion of room temperature, and therefore the distance between the superconducting coil and the end of the container for vacuum heat-shielding becomes too large. Accordingly, the distance between the compressor portion of the refrigerator and the bulk superconductor is about 0.7 m when the magnetizing static magnetic field is 5 Tesla, and is about 1.0 m when the magnetizing static magnetic field is 10 Tesla.

[Patent Document 1] Japanese Patent Laying-Open No. Hei 10-11672 (1998).

BRIEF SUMMARY OF THE INVENTION

With the conventional art mentioned above, when trying to produce a small-sized bulk superconducting magnet with shortening the diameter of the bulk superconductor, it is impossible to shorten the above-mentioned distance, i.e., the distance between the compressor portion of the refrigerator and the bulk superconductor, irrespective of a diameter of the bulk superconductor, because the compressor must be disposed within the low magnetic space. Therefore, for the heat-shielding vacuum container, it is necessary to build a long heat conductor therein, for the purpose of separating the bulk superconductor and the refrigerator, and therefore a long vacuum container is needed.

Accordingly, with the magnetizing method within the conventional static magnetic field according to the conventional art, it is impossible to shorten the length of the bulk superconducting magnet, i.e., there is a drawback that the bulk superconducting magnet cannot be made small in the sizes thereof.

An object, according to the present invention, is to provide a magnetizing system for a superconducting bulk magnet, thereby to achieve small-sizing of the bulk superconducting magnet as a whole, with shortening the length of the bulk superconducting magnet, and a small-sized bulk superconducting magnet, which is magnetized by this system.

For accomplishing the object mentioned above, according to the present invention, there is provided a magnet magnetizing system or a superconducting magnet to be magnetized, for magnetizing a superconducting magnet to be magnetized, the system, comprising: a magnetizing magnetic field generating means for generating and distinguishing a static magnetic field; a cooling means having an electromotive motor within said static magnetic field, which is generated from said magnetizing magnet generating means; and a bulk superconductor to be magnetized, which is thermally connected with a low-temperature portion of said cooling means, wherein said magnetizing magnetic field generating means is made up with a magnetizing superconducting bulk magnet, building other magnetizing bulk superconductor therein, said bulk superconductor to be magnetized before magnetization thereof is inserted within a space of the static magnetic field, which is generated by said magnetizing superconducting bulk magnet magnetized, and the magnetic field of said magnetizing superconducting bulk magnet is distinguished by said means for cooling the bulk superconductor inserted, down to be equal or lower than superconducting temperature, thereby magnetizing said bulk superconductor to be magnetized.

Also, the object mentioned above is accomplished by the magnet magnetizing system or the superconducting magnet to be magnetized, as described in the above, the system further comprising a temperature increasing means for increasing temperature of said bulk superconductor for magnetization, wherein after magnetizing said bulk superconductor to be magnetized, which is cooled by said cooling means, the static magnetic field generated by said superconducting bulk magnet by increasing temperature of said bulk superconductor for magnetization, within a space of the static magnetic field generated by the bulk superconductor for magnetization of said magnetized superconducting bulk magnet for magnetization.

Also, the object mentioned above is accomplished by the magnet magnetizing system or the superconducting magnet to be magnetized, as described in the above, wherein said magnetizing magnetic field generating means is magnetized by a coil-type superconducting magnet, which can generate and distinguish the static magnetic field, and an induced current generation suppressing means is provided for a magnet of said coil-type superconducting magnet.

Also, the object mentioned above is accomplished by the magnet magnetizing system or the superconducting magnet to be magnetized, as described in the above, wherein said induced current generation suppressing means is built up with a heater, which is thermally unified with a superconducting coil.

Also, the object mentioned above is accomplished by the magnet magnetizing system or the superconducting magnet to be magnetized, as described in the above, wherein said induced current generation suppressing means is built up with a mechanism for switching an exiting current circuit of a superconducting coil into an open circuit.

Also, the object mentioned above is accomplished by the magnet magnetizing system or the superconducting magnet to be magnetized, as described in the above, wherein said induced current generation suppressing means is built up with a mechanism for switching an exiting current circuit of a superconducting coil into a reverse induced current supply circuit.

The magnet magnetizing system, as described in the claim 1, wherein said magnetizing magnetic field generating means is magnetized by a pulse-type normal-conducting magnet, which can generate and distinguish a changing magnetic field.

According to the present invention, it is possible to provide a magnetizing system for a superconducting bulk magnet, thereby to achieve small-sizing of the bulk superconducting magnet as a whole, with shortening the length of the bulk superconducting magnet, and a small-sized bulk superconducting magnet, which is magnetized by this system.

BRIEF DESCRIPTION OF THE SEVERAL VIEWS OF THE DRAWING

Those and other objects, features and advantages of the present invention will become more readily apparent from the following detailed description when taken in conjunction with the accompanying drawings wherein.

DETAILED DESCRIPTION OF THE PREFERRED EMBODIMENTS

Hereinafter, embodiments according to the present invention will be fully explained by referring to the attached drawings.

Embodiment 1

Hereinafter, an embodiment of the present invention will be explained by referring to FIGS. 1 to 5 attached herewith.

Figure 1:
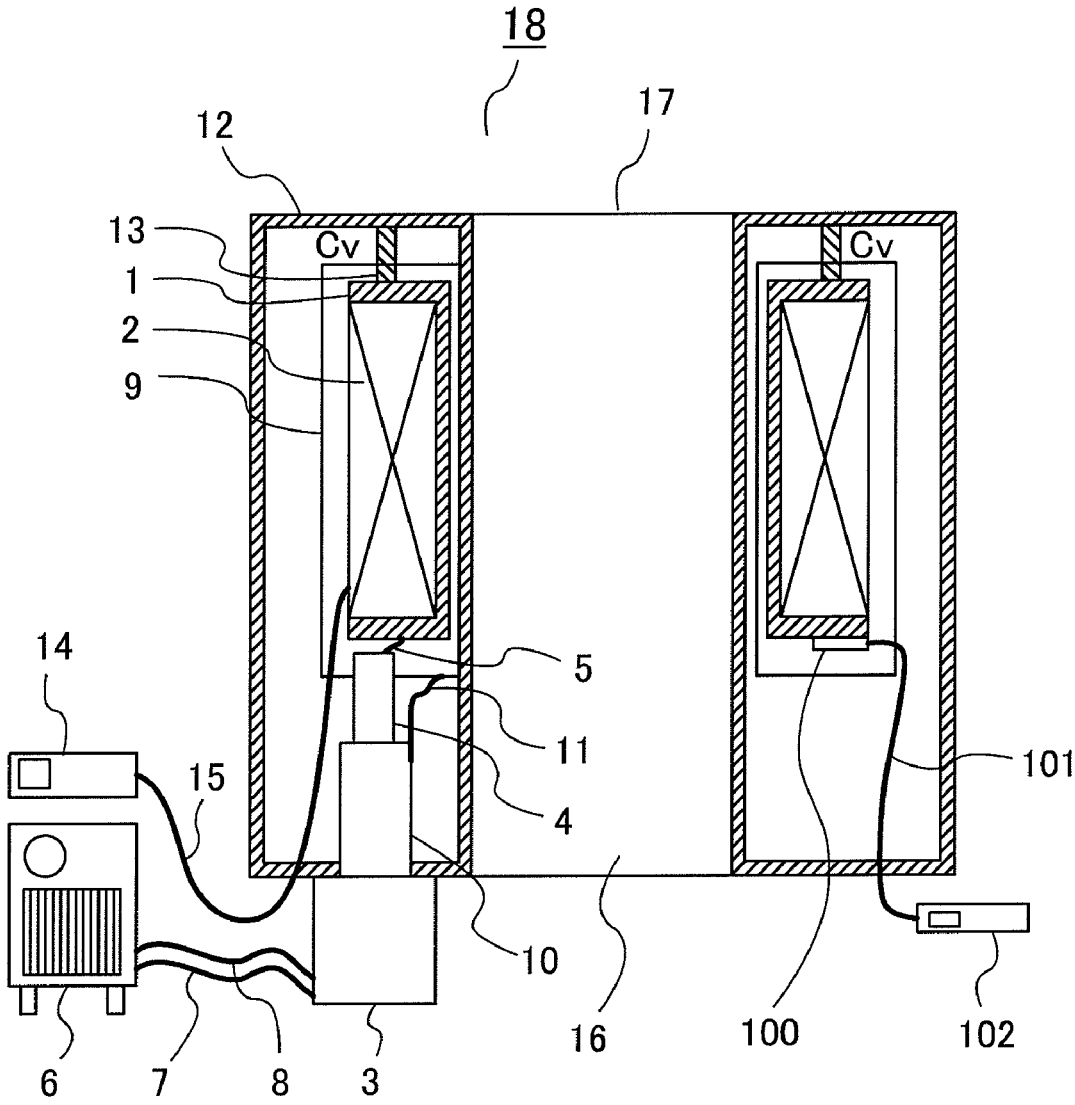
FIG. 1 is a view for explaining a superconducting magnet for magnetizing a superconducting bulk magnet for magnetization, applying an embodiment of the present invention therein.

FIG. 1 is a cross-section view of a superconducting magnet for magnetizing a superconducting bulk magnet for use of magnetization.

In FIG. 1, a superconducting coil 2, built up by winding a superconductor wire or cable, such as, of NbTi, for example, around a bobbin 1, made of copper, is connected with a cooling stage 4 at temperature 4K of the Gifford/McMahon type helium refrigerator 3, thermally, through a group of copper net-wires 5, being flexible, and is cooled down to the superconducting temperature of the NbTi cable or lower than that, i.e., around 4K. As a working gas of the helium refrigerator 3 is supplied a high pressure gas, from a compressor unit 6 through a conduit 7, and a low pressure, after being expanded within the refrigerator, is collected through a conduit 8.

A periphery of the superconducting coil 2 of very low temperature is surrounded by a heat-shielding pipe or tube 9, which is cooled down to temperature, around 50K, i.e., being protected, thermally. The heat-shielding pipe or tube 9 is thermally connected with a cooling stage 10 at temperature 50K of the helium refrigerator 3 through a group of copper net-wires 11, being flexible, and is cooled down. Those low temperature constituent elements are disposed within a vacuum container 12, to be shielded thermally through the vacuum, and the superconducting coil 2, as well as, the bobbin 1, reaching to several tens Kg in the weight thereof, are supportably fixed on a wall of room temperature of the vacuum container 12, by means of a plural pieces of heat-shielding support members 13, made of a material having small heat conductivity, such as, a plastic material, etc. An exciting current to the superconducting coil 2, equal to 100 A or larger than that, is supplied from a current source apparatus 14, which is provided at the room temperature, and is collected thereto, through very thick and heavy two (2) pieces of power source cables 15. A heating current is supplied to a heater 100, which is thermally unified with the bobbing 1, from a current source 102 through wiring 101, thereby heating the superconducting coil 2 up to temperature around 10K, exceeding the superconducting temperature.

With supplying the exiting current to the superconducting coil 2, it is possible to generate a predetermined high magnetic field at a center of a bore space at room temperature at a central portion of the coil. However, because the magnetic field leaks widely, with the superconducting coil, assuming that a diameter of the bore space 16 at room temperature is 100 mm and the magnetic field of 10 Tesla is generated at the central portion thereof, for example, then the leaking magnetic filed at a position 18 separating from an end 17 of the space 16 at room temperature by 600 mm is 0.1 Tesla. In this manner, it can be seen that the leaking magnetic field generates covering over a wide area.

Next, explanation will be made on the structures of the superconducting bulk magnet 19 for use of magnetization, by referring to FIG. 2.

Figure 2:
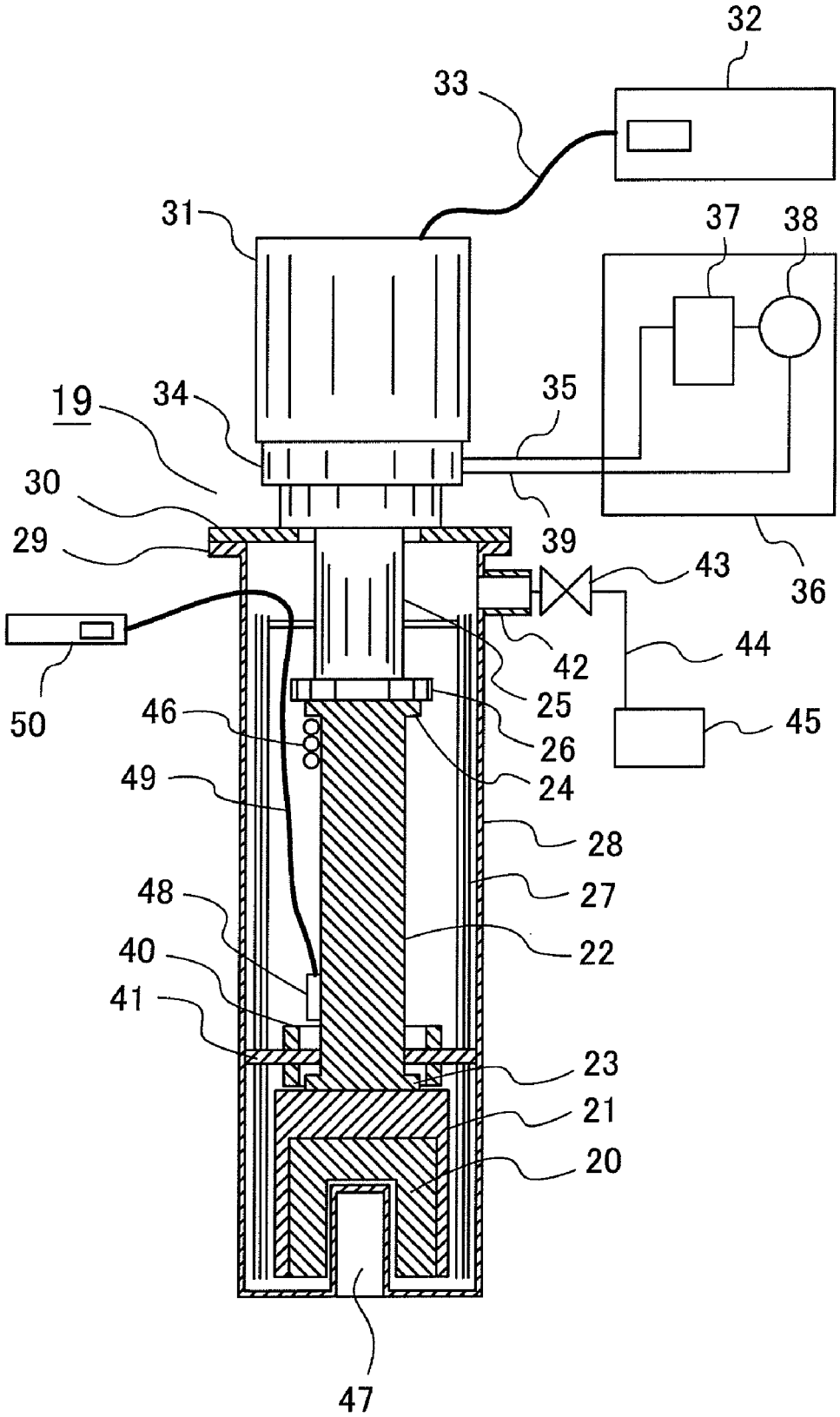
FIG. 2 is a view for explaining the superconducting bulk magnet for magnetization, applying the embodiment of the present invention therein.

FIG. 2 is a view for showing the structures of the superconducting bulk magnet 19 for use of magnetization, comprising the embodiment of the present invention therein.

In FIG. 2, a bulk superconductor 20 for capturing the magnetic field for use of magnetization is formed in a cylindrical configuration, and on the periphery thereof is unified with a protector cylinder or tube 21 made of stainless or aluminum, fixing contact portions thereof each other with an adhesive or a Wood's metal of low melting temperature, for example. A bottom portion of the protector tube 21 is thermally connected to a flange 23 of a heat conductor 22, made of copper or aluminum, for cooling, through an indium sheet or the like by means of a bolt (not shown in the figure). A flange 24 at the other end of the heat conductor 22 is thermally connected to a flange 26 of cooling stage at the cooling temperature of a small-sized helium refrigerator 25 used for cooling, around 35K, through also an indium sheet or the like by means of a bolt (not shown in the figure).

The periphery of a very low temperature portion is covered with a laminated heat-shielding member 27, and the very low temperature portion is disposed within a vacuum container 28 for the purpose of obtaining vacuum heat shielding. A vacuum container flange 29 is air-tightly connected to a flange 30 of the small-sized helium refrigerator 25, through a vacuum ring (not shown in the figure) by means of a bolt (not shown in the figure), etc. The small-sized helium refrigerator 25 builds in a compressor 31 for helium, i.e., the working gas therein, being disposed at an end thereof, and is supplied with current of several amperes from an electric power source 32 through a power cable 33, to be operated under low-temperature. Heat of compression, which is generated through compression of the helium gas within the compressor, is discharged into an outside of the refrigerator through a cooling jacket 34, which is provided at a heat-discharge portion of the compressor. A working fluid of the cooling jacket 34, such as, cooling water, for example, is collected into a cooling unit 36 through a conduit 35 made of vinyl, and after being cooled down by a refrigerator 37 operating with using other coolant or a radiator of a heat exchanger between an air (not shown in the figure), etc. a cooling unit 36, it is compressed by a pump 38 to be sent into the cooling jacket 34, through a conduit 39 made of vinyl, for example.

Also, the bulk superconductor 20 of an amount of several Kg, which is cooled down to a very low temperature, is held to be in non-contact with the vacuum container 28 at room temperature, i.e., it is important to keep the thermal invasion from increasing. In the present embodiment, in the vacuum container 28, an outer surface of the heat conductor 22 is supported by means of rods 41, each being made of a material having small thermal conductivity, such as, an epoxy resin, and movable into a radius direction of a ring 40, which is made of the epoxy resin or aluminum, through a screw, at four (4) or three (3) positions on the periphery thereof. Since a diameter of the heat conductor 22 is smaller than the diameter of the bulk superconductor 20, it is possible to support the outer surface of the heat conductor 22, in a heat-insulating manner, in the vacuum container 28, having a temperature difference, with keeping a long distance therebetween, and therefore it is possible to reduce an amount of heat invasion.

An inside of the vacuum container 28 is discharged to be a vacuum, by a vacuum pump 45 through a nozzle 42, a vacuum valve 43 and a conduit 44. On a side surface of the heat conductor 22, which is connected to the side of the cooling stage flange 26 of the refrigerator, are attached gas absorbents 46, such as, activated charcoal for use of gas absorption, for example, through an adhesive or the like. After cooling the bulk superconductor 20 down to the very low temperature by the refrigerator 25, and after the gas absorbents 46 are cooled down to be equal or lower than an absorption temperature, the vacuum valve 43 is closed, and therefore the conduit 44 and the vacuum pump 45 can be separated from each other, to be transferred easily.

At a tip of the vacuum container 28 has a recessed space 47 of room temperature. Further, there are provided a heater 48, which is thermally connected to the heat conductor 22, wiring 49 and a current source 50, to obtain such a structure for supplying heating current from the current source 50, thereby heating up the bulk superconductor 20, quickly, up to temperature exceeding over the superconducting temperature.

Figure 3:
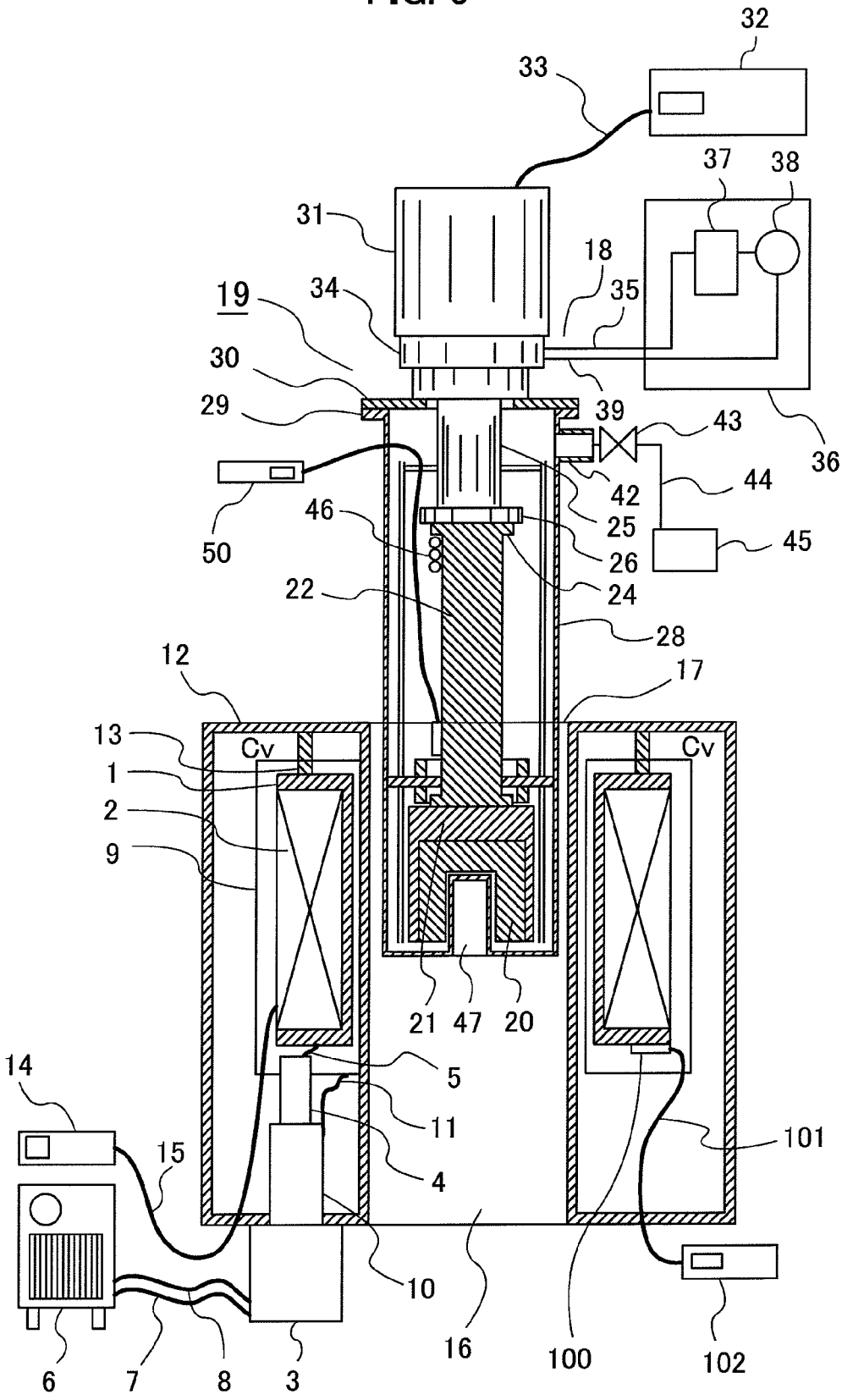
FIG. 3 is a view for explaining the structures for magnetizing the superconducting bulk magnet for magnetization shown in FIG. 2 by the superconducting magnet shown in FIG. 1, applying the embodiment of the present invention therein.

FIG. 3 is a view for explaining the structures for magnetizing the superconducting bulk magnet for use of magnetization, having the embodiment of the present invention therein.

In FIG. 3, a predetermined exciting current is supplied to the superconducting coil 2, which is cooled down to the very low temperature, from the current source apparatus 14, thereby generating a predetermined high magnetic field at a central portion of the bore space 16 at room temperature, for example, a high magnetic field of 10 Tesla at the central portion of the bore space 16 at room temperature having the diameter of 100 mm. In this instance, the leaking magnetic field is 0.1 Tesla at the position 18 separating from the end portion 17 of the space 16 of room temperature by 600 mm. Accordingly, setting is made so that the compressor 31 of the superconducting bulk magnet 19 for use of magnetization at the position 18, and the bulk superconductor 20 at room temperature is disposed at the central portion of the bore space 16 at room temperature. An air inside the vacuum container 28 is discharged into a vacuum by the vacuum pump 45, and current of several amperes is supplied from the electric power source 32 through the power cable 33, thereby to operate the refrigerator 25 under the low temperature. At this point, a magnetic flux of 10 Tesla within the space at room temperature penetrates through the bulk superconductor 20, which does not reach to the superconducting temperature.

After the bulk superconductor 20 is cooled down to be equal or lower than the superconducting temperature, and the temperature thereof is in a steady state, an induced current is generated in the bulk superconductor 20 when reducing the current of the superconducting coil 2 by sweeping the exiting current from the current source apparatus 14. This induced current continues to flow without decrease or attenuation since the bulk superconductor 20 is in the superconducting condition, and the magnetic field is generated and the magnetic field is captured. At a time point when no current flows within the superconducting coil 2, the magnetization is completed in the bulk superconductor 20. Thereafter, operation of the refrigerator 3 is stopped, and further heating current is supplied to the heater 100, which is thermally unified with the bobbin 1, through the wiring 101, thereby heating the superconducting coil 2 up to temperature exceeding the superconducting temperature of the superconducting coil 2, i.e., around 10K.

In this condition, the superconducting bulk magnet 19 for use of magnetization is pull out from the space 16 at room temperature In this time, since in the superconducting coil 2 is generated the induced current, for building up a magnetic field in such a direction to trap this magnetic field in the space 16 at room temperature, due to the magnetic field generated by the bulk superconductor 20, then such a suction force is generated on the superconducting bulk magnet 19 for use of magnetization, as to bring hard to be pulled out, and a tension force is generated on the helium refrigerator 25. However, since the superconducting coil 2 is heated and therefore not in the superconducting state, then the induced current generated distinguishes through Joule heat, and therefore a resistance against the pulling-out comes to be small, so that the bulk magnet could be pulled out from the space 16 at room temperature, easily, within a short time period.

Figure 4:
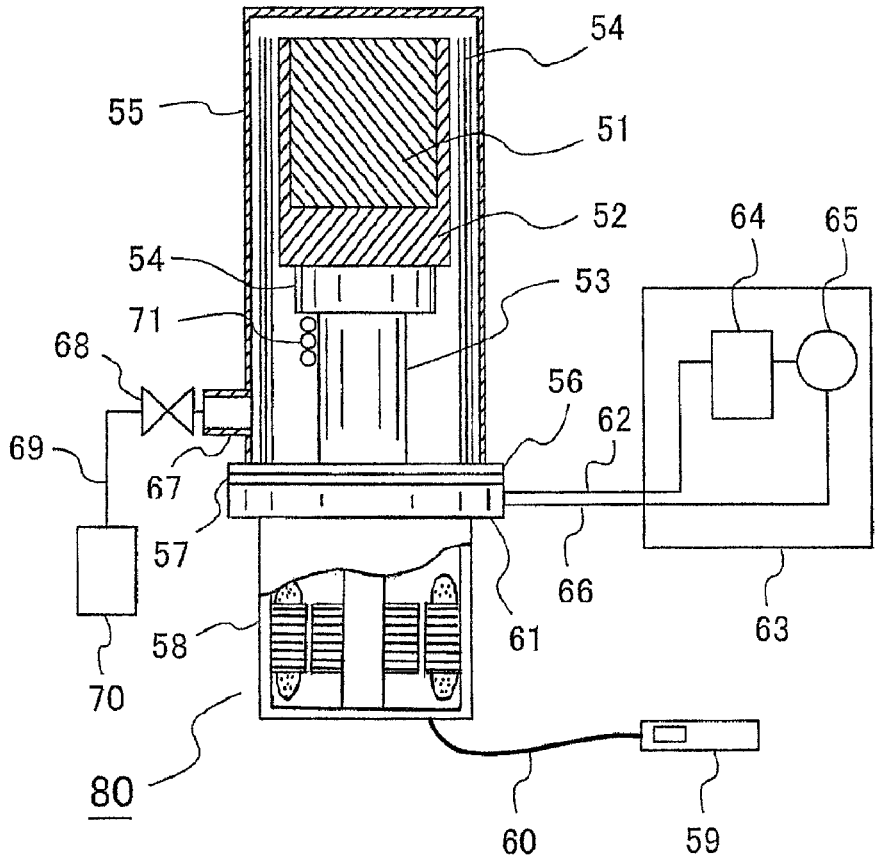
FIG. 4 is a view for showing the structures of a small-sized superconducting bulk magnet, applying the embodiment of the present invention therein.

FIG. 4 is a view for explaining the structures the small-sized superconducting bulk magnet, having the embodiment of the present invention therein.

In FIG. 4, a small-sized bulk superconductor 51 is magnetized within a small-sized superconducting bulk magnet 80 so that capturing the magnetic field is formed into a column-like shape, and the periphery thereof is in a protecting tubular body 52 of stainless steel or aluminum, fixing the portion contacting with each other by an adhesive or Wood's metal having low melting temperature, and they are also thermally connected to each other. A bottom portion of the protecting tubular body 52 is thermally connected to a cooling stage flange 54 of a small-sized helium refrigerator 53 for cooling down to cooling temperature around 40K, by means of a bolt (not shown in the figure), through an indium sheet or the like, for the purpose of cooling thereof.

The periphery of the very low temperature portion of the small-sized bulk superconductor 51 is covered with a laminated heat-shielding member 54. Also, the very low temperature portion is disposed within a vacuum container 55 for vacuum shielding thereof. A vacuum container flange 56 is air-tightly connected to a flange 57 of the small-sized helium refrigerator 53, by means of a bolt (not shown in the figure), or the like, through a vacuum ring (not shown in the figure), for example. The small-sized helium refrigerator 53 build in a compressor 58 and supplied with helium which is disposed at an end thereof, and is also supplied with current of several amperes from an electric power source 59 through a power cable 60, to be operated under low-temperature. Heat of compression, which is generated through compression of the helium gas within the compressor 58, is discharged into an outside of the refrigerator 53 through a cooling jacket 61, which is provided at a heat-discharge portion of the compressor 58. A working fluid of the cooling jacket 61, such as, cooling water, for example, is collected into a cooling unit 63 through a conduit 62 made of vinyl, and after being cooled down by a refrigerator 64 operating with using other coolant or a radiator of a heat exchanger between an air (not shown in the figure), etc., within a cooling unit 63, it is compressed by a pump 65 to be sent into the cooling jacket 61, through a conduit 66 made of vinyl, for example.

An inside of the vacuum container 55 is discharged to be a vacuum, by a vacuum pump 70 through a nozzle 67, a vacuum valve 68 and a conduit 69. In the vicinity of the cooling stage flange 54 of the small-sized helium refrigerator 53 is attached gas absorbents 71, such as, activated charcoal for use of gas absorption, for example, through an adhesive or the like. After cooling the small-sized bulk superconductor 51 down to the very low temperature by the small-sized helium refrigerator 53, and after the gas absorbents 71 are cooled down to be equal or lower than an absorption temperature, the vacuum valve 68 is closed, and therefore the conduit 69 and the vacuum pump 70 can be separated from each other, to be transferred easily.

Figure 5:
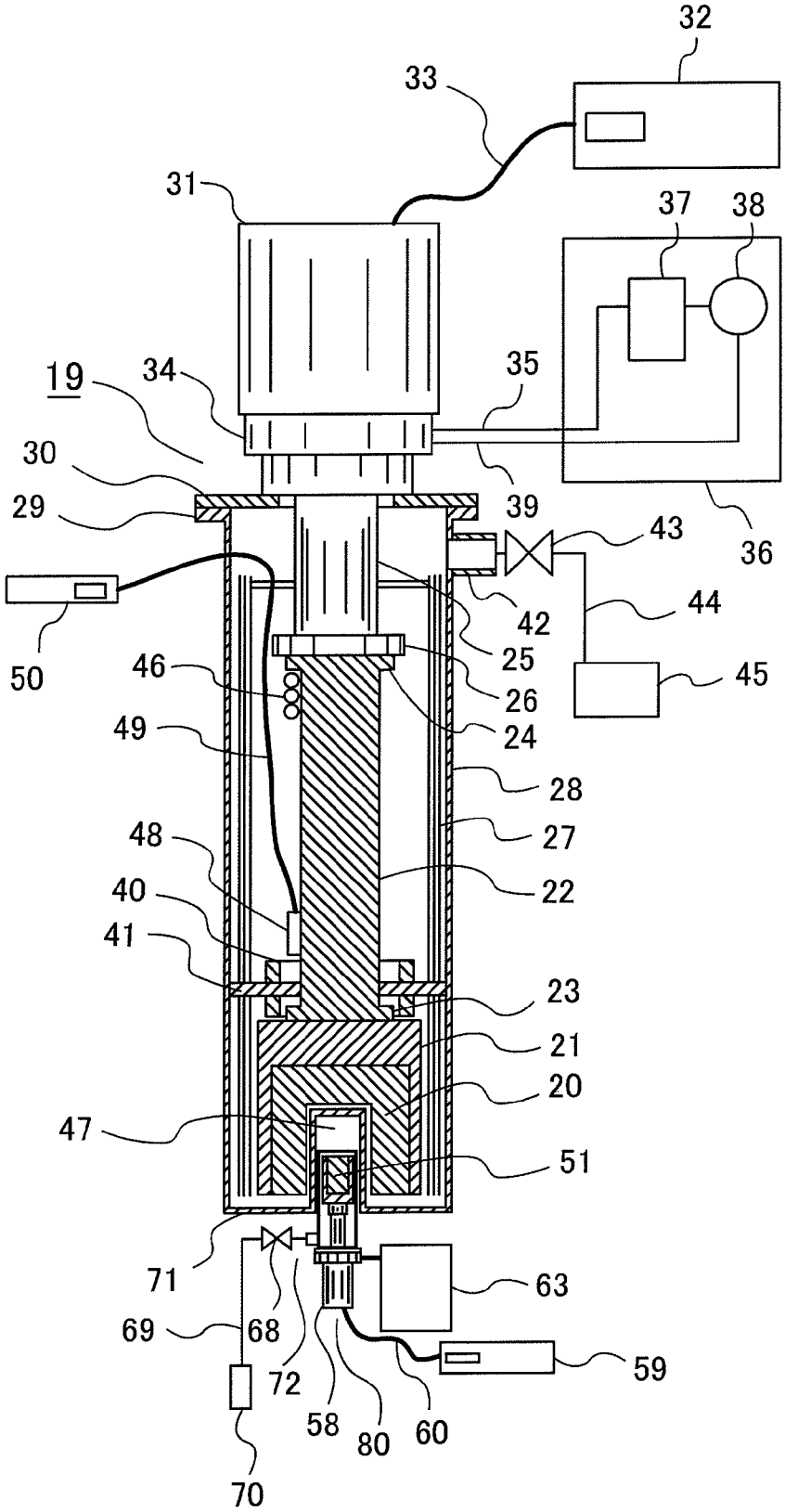
FIG. 5 is a view for showing the structures for magnetizing the small-sized superconducting bulk magnet shown in FIG. 4 by the superconducting bulk magnet for magnetization, which is magnetized in FIG. 3, applying the embodiment of the present invention therein.

FIG. 5 is a view for explaining the structures for magnetizing the small-sized superconducting bulk magnet by the superconducting bulk magnet for use of magnetization.

In FIG. 5, within the superconducting bulk magnet 19, which is magnetized with the method explained in FIG. 3, the magnetic fluxes captured by the magnetized bulk superconductor 20 build up a strong magnetic field of about 7 Tesla, within the space 47 at room temperature. However, the space of leaking magnetic field is narrow, i.e., a position 72 separating from an end surface 71 of the magnet is around 60 mm, which is a boundary of the leaking magnet field of 0.1 Tesla. Accordingly, setting is made so that the small-sized bulk superconductor 51 at room temperature is disposed within the space 47 at room temperature while disposing the compressor 58 for the small-sized superconducting bulk magnet 80 within a space of the magnetic field equal or lower than 0.1 Tesla. Discharging an air within the vacuum container 55 (shown in FIG. 4) by the vacuum pump 70 with opening the vacuum valve 68, and current of several amperes is supplied from the electric power source 59 through the power cable 60, thereby to operate the small-sized helium refrigerator 53 (shown in FIG. 4) under low temperature. At this point, a magnetic flux of 7 Tesla within the space at room temperature penetrates through the small-sized bulk superconductor 51, which does not reach to the superconducting temperature.

After the small-sized bulk superconductor 51 is cooled down to a temperature, which is equal or lower than the superconducting temperature and the temperature thereof is in a steady state, the refrigerating operation of the helium refrigerator 25 for the superconducting bulk magnet 19 for magnetization is stopped and a heating current is supplied from the current source 50 so as to heat up the heater 48, and thereby heating the bulk superconductor 20 up to the temperature higher than the superconducting temperature 100K. When the bulk superconductor 20 is heated to be higher than 100K of the temperature thereof, the magnetic fluxes captured by the bulk superconductor 20 distinguished. When the magnetic field within the space 47 at room temperature is reduced, an induced current is produced in the small-sized superconducting bulk magnet 51, and that induced current can continue to flow without decrease or attenuation since the small-sized superconducting bulk magnet 51 is in the superconducting condition, and the magnetic field is generated and the magnetic field is captured. At a time point when no current flows in the bulk superconductor 20, the magnetization is completed upon the small-sized bulk superconductor 51.

In this condition, a small-sized superconducting bulk magnet 80 is pull out from the space 47 at room temperature of the superconducting bulk magnet 19 for magnetization. In this time, since the bulk superconductor 20 is an insulating body since it is not in the superconducting state, no induced current is generated, and therefore the bulk magnet 80 can be pulled out from the space 47 at room temperature, easily.

Doing in this manner, the small-sized bulk superconductor 51 of the small-sized superconducting bulk magnet 80 can capture the magnetic field of about 6 Tesla. Accordingly, there is no necessity of a member corresponding to the long heat conductor 22, which was necessary for disposing the compressor for the refrigerator outside the field of leaking magnetic field of 0.1 Tesla, as is in the case of the superconducting bulk magnet 19 for magnetization, then it is possible to shorten the length of the main body of the superconducting magnet of a refrigerator-cooling type. Therefore, there could be obtained an effect for enabling to generate a strong magnetic field on a surface by a magnet of lightweight and low-cost.

In this manner, with the present embodiment, since there can be provided the superconducting bulk magnet 80 for magnetization, which was magnetized by a coil-type magnet in advance, as a magnetization magnet for narrowing a region of the leaking magnetic field in an outside of the magnet, it is possible to shorten the length of the magnet including the refrigerator for the other refrigerator cooling type superconducting bulk magnet to be magnetized; there could be achieved an effect of obtaining small-sizing and light-weighting of the refrigerator-cooling type superconducting bulk magnet.

Also, with the present embodiment, since the surface area thereof can be reduced by shortening the length of the low-temperature portion of the refrigerator-cooling type superconducting bulk magnet, then it is possible to reduce an amount of thermal invasion from the portion at room temperature, and for this reason, a cooling capacity can be made small, of the refrigerator to be unified for cooling down to a predetermined temperature. With this, it is possible to reduce the cost of the refrigerator and the cost of the refrigerator-cooling type superconducting bulk magnet.

Embodiment 2

Figure 6:
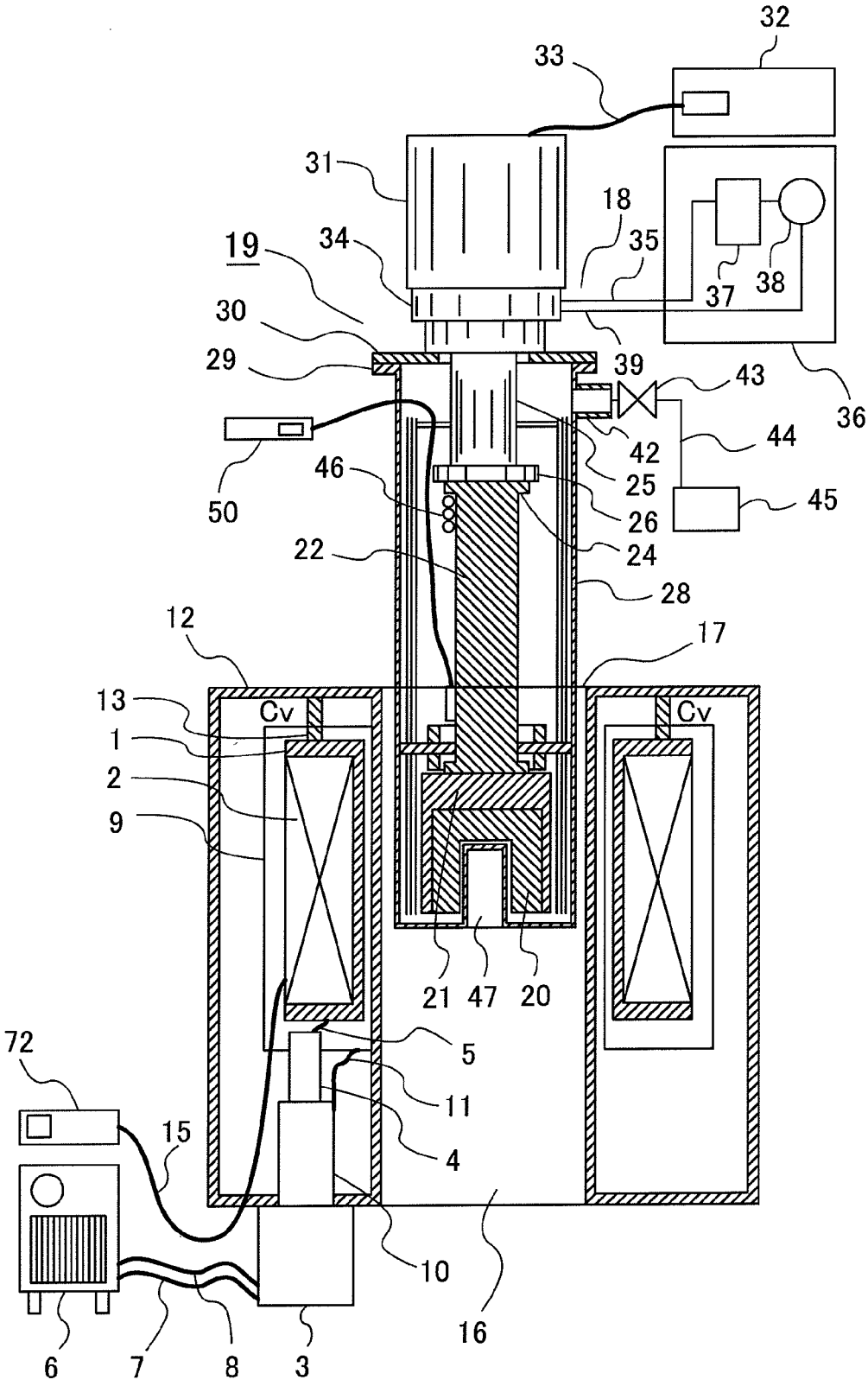
FIG. 6 is a view for showing the structures for magnetizing the superconducting bulk magnet shown in FIG. 2 by the superconducting magnet, applying other embodiment of the present invention therein.

FIG. 6 is a view for explaining the structures for magnetizing the superconducting bulk magnet for magnetization, which has a second embodiment therein.

In FIG. 6, an aspect of the present embodiment differing from that shown in FIG. 3 lies in that, after the bulk superconductor 20 is cooled down to a temperature equal or lower than the superconducting temperature, and the temperature is in the steady state thereof, an induced current is generated in the bulk superconductor 20 when reducing the current of the superconducting coil 2 by sweeping the exiting current from the current source apparatus 72. This induced current continues to flow without decrease or attenuation because the bulk superconductor 20 is in the superconducting condition, and the magnetic field is generated and the magnetic field is captured. At a time point when no current flows within the superconducting coil 2, the magnetization is completed upon the bulk superconductor 20. Thereafter, operation of the refrigerator 3 is stopped.

Herein, within the exiting current circuit of the current source apparatus 72 is made up a circuit for building up an open circuit (not shown in the figure), and there is also provided an exchange switch (not shown in the figure) for switching to that open circuit. After stopping the operation of the refrigerator 3, the exiting current circuit is switched into the open circuit. In this condition, the superconducting bulk magnet 19 for magnetization is pulled out from the space 16 at room temperature. In this instance, due to the magnetic field generated by the bulk superconductor 20, an induced current tries to generate in the superconducting coil 2, for building up the magnetic field in a directing of closing this magnetic field within the space 16 at room temperature. However, with switching the exiting current circuit into the open circuit, no induced current flow therein, and there can be obtain an effect that the resistance against pulling-out come to be small, and that the bulk magnet can be pulled out from the space 16 at room temperature, easily.

Embodiment 3

Figure 7:
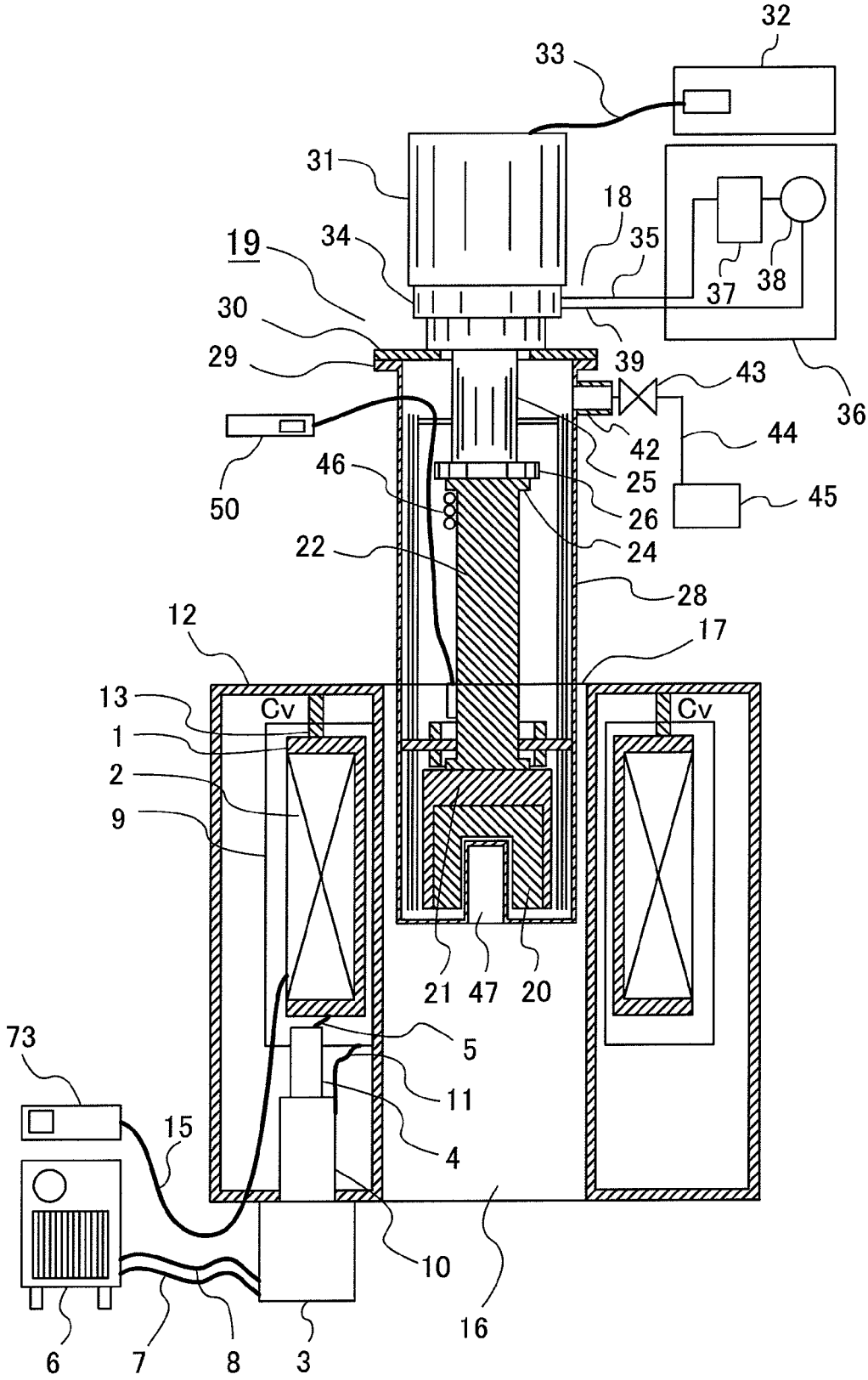
FIG. 7 is a view for showing the structures for magnetizing the superconducting bulk magnet shown in FIG. 2 by the superconducting magnet, applying further other embodiment of the present invention therein.

FIG. 7 is a view for explaining the structures for magnetizing the superconducting bulk magnet for magnetization, which has an embodiment 3 therein.

In FIG. 7, an aspect of the present embodiment differing from that shown in FIG. 6 lies in that, after the bulk superconductor 20 is cooled down to a temperature equal or lower than the superconducting temperature, and the temperature is in the steady state thereof, an induced current is generated in the bulk superconductor 20 when reducing the current of the superconducting coil 2 by sweeping the exiting current from the current source apparatus 73. This induced current continues to flow without decrease or attenuation because the bulk superconductor 20 is in the superconducting condition, and the magnetic field is generated and the magnetic field is captured. At a time point when no current flows within the superconducting coil 2, the magnetization is completed upon the bulk superconductor 20. Thereafter, operation of the refrigerator 3 is stopped. Herein, within the exiting current circuit of the current source apparatus 73 is made up a circuit for building up a reverse induced current circuit (not shown in the figure) for flowing current in a direction reversing to the induced current to be generated, and there is also provided an exchange switch (not shown in the figure) for switching to that circuit. After stopping the operation of the refrigerator 3, the exiting current circuit is switched into the reverse induced current circuit. In this condition, the superconducting bulk magnet 19 for magnetization is pulled out from the space 16 at room temperature. In this instance, since a magnetic force is built up on the superconducting coil 2, in a direction of pushing out the bulk superconductor 20 magnetized, it can be pulled out easily, and there can be obtained an effect that it can be pulled out from the space 16 at room temperature within a shot time-period.

Embodiment 4

Figure 8:
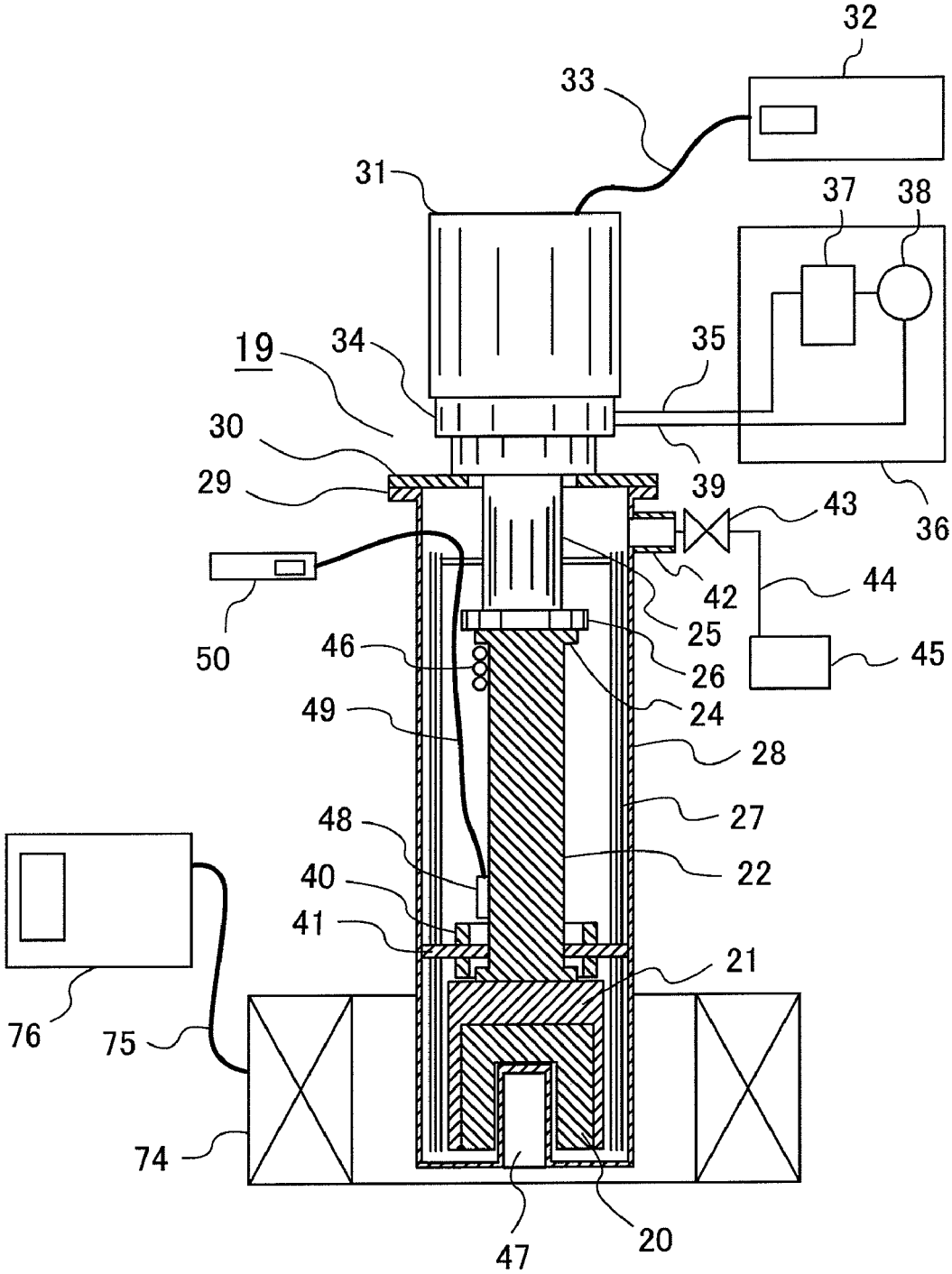
FIG. 8 is a view for showing the structures for magnetizing the superconducting bulk magnet shown in FIG. 2 by the superconducting magnet, applying further other embodiment of the present invention therein.

FIG. 8 is a view for explaining the structures for magnetizing the superconducting bulk magnet for magnetization, which has an embodiment 4 therein.

In FIG. 8, an aspect of the present embodiment differing from that shown in FIG. 3 lies in that, after the bulk superconductor 20 is cooled down to a temperature equal or lower than the superconducting temperature, from the bulk superconductor 20 cooled down to the temperature of liquid nitrogen to a normal-conducting coil 74, a pulse-like current is supplied from a pulse current source 76 through wiring 75, i.e., there is disclosed the construction of the magnetizing method for magnetizing the bulk superconductor 20, in accordance with the method for compulsively entering magnetic fluxes, in a pulse-like manner, into the bulk superconductor 20 in the superconducting state.

With the present embodiment, though the magnetic field is small, which can be magnetized on the bulk superconductor 20, but the coil for magnetization can be built up with a normal-conducting magnet, and there can be obtained an effect of reducing the costs of the constituent parts thereof.

In this manner, with the present embodiment, since the superconducting bulk magnet for magnetization, which was magnetized by the coil-type magnet in advance, is provided as the magnet for magnetization, so as to narrow the region of the leaking magnetic field in the outside of the magnet, it is possible to provide a magnet for narrowing the region of the leaking magnetic field, and with this, there could be obtained an effect that the magnetization can be achieved upon the superconducting bulk magnet being short in the length of the magnet, including the refrigerator for the other refrigerator cooling type superconducting bulk magnet to be magnetized, and with this magnetization operating method, there can be obtained also an effect of providing a small-sized refrigerator-cooling type superconducting bulk magnet, which is short in the length and light in the weight thereof.

As was mentioned above, with the present invention, since the leaking magnetic field is small when using the superconducting bulk magnet for magnetization therein, then it is not necessary to provide the member corresponding to the long heat conductor 22, which is necessary for disposing the compressor of the refrigerator for the superconducting bulk magnet to be magnetized within an outside of the magnetic field where the leaking magnetic field is 0.1 Tesla, and therefore it is possible to shorten the length of the superconducting bulk magnet to be magnetized, as a whole, and for this reason, there can be obtained an effect of enabling to generate a strong magnetic field on the surface thereof, by a magnet, being lighter in the weight and with a low cost.

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications that fall within the ambit of the appended claims.

What is claimed is:

1. A magnet magnetizing system, for magnetizing a superconducting magnet to be magnetized, comprising:

a magnetizing magnetic field generating means for generating and distinguishing a static magnetic field;

a cooling means having an electromotive motor within said static magnetic field, which is generated from said magnetizing magnet generating means; and a bulk superconductor to be magnetized, which is thermally connected with a low-temperature portion of said cooling means, wherein said magnetizing magnetic field generating means is made up with a magnetizing superconducting bulk magnet, building said magnetizing bulk superconductor therein, said bulk superconductor to be magnetized before magnetization thereof is inserted within a space of the static magnetic field, which is generated by said magnetizing superconducting bulk magnet magnetized, said bulk superconductor cooled down to a temperature equal or lower than a superconducting temperature by said cooling means for cooling the bulk superconductor inserted, and the magnetic field of said magnetizing superconductor bulk magnet is distinguished, thereby magnetizing said bulk superconductor to be magnetized.

2. The magnet magnetizing system, as described in the claim 1, further comprising a temperature increasing means for increasing temperature of said bulk superconductor for magnetization, wherein after magnetizing said bulk superconductor to be magnetized, which is cooled by said cooling means, the static magnetic field generated by said superconducting bulk magnet by increasing temperature of said bulk superconductor for magnetization, within a space of the static magnetic field generated by the bulk superconductor for magnetization of said magnetized superconducting bulk magnet for magnetization.

3. The magnet magnetizing system, as described in the claim 1, wherein said magnetizing magnetic field generating means is magnetized by a coil-type superconducting magnet, which can generate and distinguish the static magnetic field, and an induced current generation suppressing means is provided for a magnet of said coil-type superconducting magnet.

4. The magnet magnetizing system, as described in the claim 3, wherein said induced current generation suppressing means is built up with a heater, which is thermally connected with a superconducting coil.

5. The magnet magnetizing system, as described in the claim 3, wherein said induced current generation suppressing means is built up with a mechanism for switching an exiting current circuit of a superconducting coil into an open circuit.

6. The magnet magnetizing system, as described in the claim 3, wherein said induced current generation suppressing means is built up with a mechanism for switching an exiting current circuit of a superconducting coil into a reverse induced current supply circuit.

7. The magnet magnetizing system, as described in the claim 1, wherein said magnetizing magnetic field generating means is magnetized by a pulse-type normal-conducting magnet, which can generate and distinguish a changing magnetic field.

8. A superconducting magnet to be magnetized, comprising:

a magnetizing magnetic field generating means for generating and distinguishing a static magnetic field;

a cooling means having an electromotive motor within said static magnetic field, which is generated from said magnetizing magnet generating means; and a bulk superconductor to be magnetized, which is thermally connected with a low-temperature portion of said cooling means, wherein said magnetizing magnetic field generating means is made up with a magnetizing superconducting bulk magnet, building said magnetizing bulk superconductor therein, said bulk superconductor to be magnetized before magnetization thereof is inserted within a space of the static magnetic field, which is generated by said magnetizing superconducting bulk magnet magnetized, said bulk superconductor cooled down to a temperature equal or lower than a superconducting temperature by said cooling means for cooling the bulk superconductor inserted, and the magnetic field of said magnetizing superconductor bulk magnet is distinguished, thereby magnetizing said bulk superconductor to be magnetized.

9. The superconducting magnet to be magnetized, as described in the claim 8, further comprising a temperature increasing means for increasing temperature of said bulk superconductor for magnetization, wherein after magnetizing said bulk superconductor to be magnetized, which is cooled by said cooling means, the static magnetic field generated by said superconducting bulk magnet by increasing temperature of said bulk superconductor for magnetization, within a space of the static magnetic field generated by the bulk superconductor for magnetization of said magnetized superconducting bulk magnet for magnetization.

10. The superconducting magnet to be magnetized, as described in the claim 8, wherein said magnetizing magnetic field generating means is magnetized by a coil-type superconducting magnet, which can generate and distinguish the static magnetic field, and an induced current generation suppressing means is provided for a magnet of said coil-type superconducting magnet.

11. The superconducting magnet to be magnetized, as described in the claim 10, wherein said induced current generation suppressing means is built up with a heater, which is thermally unified with a superconducting coil.

12. The superconducting magnet to be magnetized, as described in the claim 10, wherein said induced current generation suppressing means is built up with a mechanism for switching an exiting current circuit of a superconducting coil into an open circuit.

13. The superconducting magnet to be magnetized, as described in the claim 10, wherein said induced current generation suppressing means is built up with a mechanism for switching an exiting current circuit of a superconducting coil into a reverse induced current supply circuit.

14. The superconducting magnet to be magnetized, as described in the claim 8, wherein said magnetizing magnetic field generating means is magnetized by a pulse-type normal-conducting magnet, which can generate and distinguish a changing magnetic field.

* * * * *